US012649613B2

(12) United States Patent
Chung

(10) Patent No.: US 12,649,613 B2
(45) Date of Patent: Jun. 9, 2026

(54) DROPPER CONTAINER

(71) Applicant: David C. Chung, Incheon (KR)

(72) Inventor: David C. Chung, Incheon (KR)

( * ) Notice: Subject to any disclaimer, the term of this patent is extended or adjusted under 35 U.S.C. 154(b) by 182 days.

(21) Appl. No.: 18/599,156

(22) Filed: Mar. 7, 2024

(65) Prior Publication Data

US 2025/0026547 A1 Jan. 23, 2025

(30) Foreign Application Priority Data

Jul. 21, 2023 (KR) ..... 10-2023-0095000

(51) Int. Cl.
*B65D 47/18* (2006.01)

(52) U.S. Cl.
CPC ..... *B65D 47/18* (2013.01); *B65D 2547/063* (2013.01)

(58) Field of Classification Search
CPC ..... B65D 47/18; B65D 2547/063
See application file for complete search history.

(56) References Cited

U.S. PATENT DOCUMENTS

| | | | | |
|---|---|---|---|---|
| 2017/0043918 | A1* | 2/2017 | Guo | B65D 47/18 |
| 2022/0212842 | A1* | 7/2022 | Lee | A45D 34/04 |
| 2022/0331791 | A1* | 10/2022 | Bulla | B01L 3/0217 |
| 2025/0026547 | A1* | 1/2025 | Chung | B65D 47/18 |

FOREIGN PATENT DOCUMENTS

| | | | | |
|---|---|---|---|---|
| JP | H0620265 | U * | 3/1994 | |
| KR | 101483652 | B1 * | 1/2015 | B01L 3/02 |
| KR | 101785716 | B1 * | 10/2017 | A45D 34/046 |
| KR | 102334654 | B1 * | 12/2021 | B01L 3/02 |
| KR | 10-2022-0101840 | A | 7/2022 | |
| KR | 10-2023-0014454 | A | 1/2023 | |
| KR | 20230001196 | A * | 1/2023 | B65D 47/18 |
| KR | 20230001470 | A * | 1/2023 | A45D 40/26 |
| WO | WO-2012010793 | A1 * | 1/2012 | B05B 11/1064 |
| WO | WO-2021048447 | A1 * | 3/2021 | A45D 34/04 |

* cited by examiner

*Primary Examiner* — Bob Zadeh
(74) *Attorney, Agent, or Firm* — Bridgeway IP Law Group, PLLC; Sang Ho Lee; Hyun Woo Shin

(57) ABSTRACT

The present disclosure relates to a dropper container, which includes: a container body for accommodating contents; and a pipette cap for coupling to the container body, wherein at least a portion of the pipette cap is formed integrally with a pipette for dispensing the contents.

7 Claims, 8 Drawing Sheets

DROPPER CONTAINER

CROSS-REFERENCE TO RELATED APPLICATIONS

This application claims the priority of Korean Patent Application No. 10-2023-0095000 filed on Jul. 21, 2023, in the Korean Intellectual Property Office, the entire content of which is incorporated herein by reference.

BACKGROUND OF THE INVENTION

Field of the Invention

The present disclosure relates to a dropper container, and more specifically, to a dropper container, in which a pipette and a cap for dispensing contents are formed integrally to reduce the number of components, reduce plastic usage, and simplify manufacturing processes, thereby achieving environmental friendliness and cost reduction.

Background Art

In general, a content container is configured to accommodate contents in a container body and open and dispense the contents by opening and closing the container body via a lid. However, such a method has difficulties in controlling the amount of contents dispensed from the container body and is not hygienic since being susceptible to contamination.

As a solution, a method of individually packaging contents in small amounts so that the required amount can be used in each use cycle, such as in a capsule form, has been developed. However, the individual packaging method leads to environmental pollution and increases manufacturing costs since using plastic as the main packaging material.

In order to overcome the problems of the individual packaging method, a container having a pipette-type dispensing means capable of controlling the discharge amount by a user's pressure after accommodating contents in the container has been developed. However, the container having a pipette-type dispensing means typically includes various components made of different materials, such as a pipette part made of glass, a pressurizing part made of rubber material to induce pressure changes inside the pipette, and a cap made of plastic material for coupling the pipette, thus making it difficult for separation and disposal and complicating the manufacturing process.

SUMMARY OF THE INVENTION

Accordingly, the present disclosure has been made to solve the above-mentioned problems occurring in the prior arts, and it is an objective of the present disclosure to provide a dropper container, in which a pipette and a cap for dispensing contents are formed integrally to reduce the number of components, reduce plastic usage, and simplify manufacturing processes, thereby achieving environmental friendliness and cost reduction.

The objectives of the present disclosure are not limited to those mentioned above, and other objectives not mentioned herein will be clearly understood by those skilled in the art from the following description.

To accomplish the above object, according to the present disclosure, there is provided a dropper container including: a container body for accommodating contents; and a pipette cap for coupling to the container body, wherein at least a portion of the pipette cap is formed integrally with a pipette for dispensing the contents.

As described above, according to an embodiment of the present disclosure, the dropper container can provide economic feasibility and environmental friendliness by reducing the amount of plastic used.

Furthermore, according to an embodiment of the present disclosure, the dropper container can reduce manufacturing costs by simplifying the manufacturing process.

Moreover, according to an embodiment of the present disclosure, the dropper container which is composed of materials of the same series can be disposed of as a whole without the need to separate parts for disposal. Therefore, the dropper container is easily recyclable and environmentally friendly.

The advantages of the present disclosure are not limited to the above-mentioned advantages, and other advantages, which are not specifically mentioned herein, will be clearly understood by those skilled in the art from the following description.

BRIEF DESCRIPTION OF THE DRAWINGS

Regarding the description of the drawings, identical or similar reference numerals may be used for identical or similar components.

DETAILED DESCRIPTION OF THE PREFERRED EMBODIMENT

Figure 1:
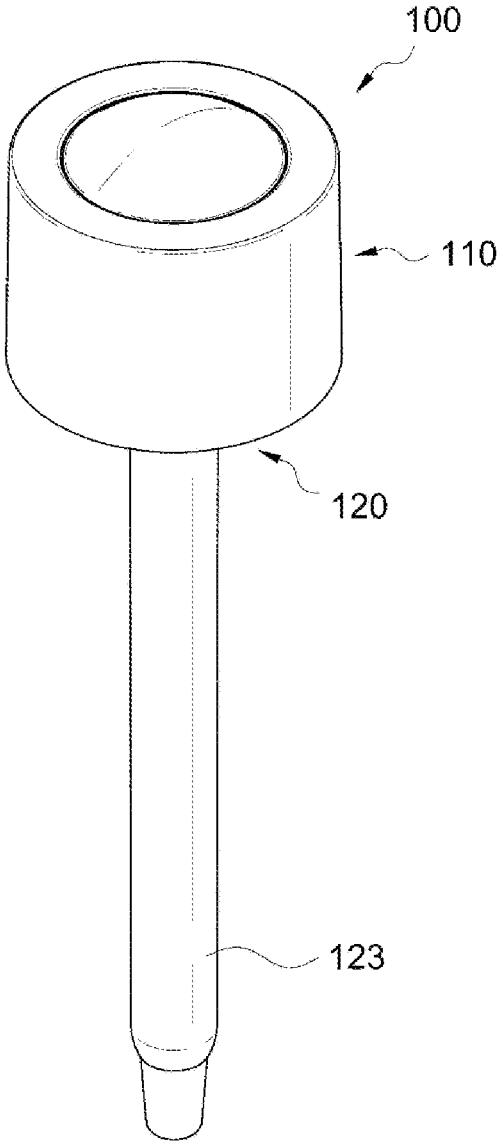
FIG. 1 is a perspective view of a pipette cap according to an embodiment of the present disclosure.

Hereinafter, the embodiments of the present disclosure will be described in detail with reference to accompanying drawings so that the embodiments may be easily implemented by those skilled in the art. However, the present disclosure may be implemented in various ways without being limited to the embodiments. In addition, in the drawings, well-known elements or components may be omitted to avoid unnecessarily obscuring the presented embodiments, and like reference numerals denote like elements throughout the specification.

The terms including descriptive or technical terms which are used herein should be construed as having meanings that are obvious to one of ordinary skill in the art. However, the terms may have different meanings according to an intention of one of ordinary skill in the art, precedent cases, or the appearance of new technologies. Therefore, the terms used in the present disclosure should not be interpreted solely based on the names of the terms, but should be interpreted based on the meanings of the terms and the contents throughout the present disclosure.

Additionally, terms such as first and/or second may be used to describe various components, but the components are not limited to the terms. The terms are only for the purpose of distinguishing one component from other components, for example, without departing from the scope of the present disclosure, a first component may be referred to as a second component, and similarly, a second component may also be referred to as a first component. The terms, 'and/or', is used to indicate a combination of multiple related items or includes any one of multiple related items.

The terminology used herein is for the purpose of describing particular embodiments only and is not intended to be limiting. The singular expressions are intended to include the plural expressions, unless the context clearly indicates otherwise. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Throughout the specification, when one part is described to be "connected" to another part, it includes not only being "directly connected" but also being "indirectly connected" with other structures in between. Furthermore, when one part "includes" another component, it means not excluding the possibility of including other components unless specifically stated otherwise.

In this disclosure, the phrase such as "in an embodiment" that frequently appears do not necessarily all refer to the same embodiment.

Hereinafter, embodiments of the present disclosure will be described in detail with reference to the accompanying drawings.

In an embodiment of the present disclosure, a dropper container 1000 includes: a container body 200 for accommodating contents; and a pipette cap 100 for coupling to the container body 200, wherein at least a portion of the pipette cap 100 can be integrally formed with a pipette 123 to dispense the contents.

Figure 2:
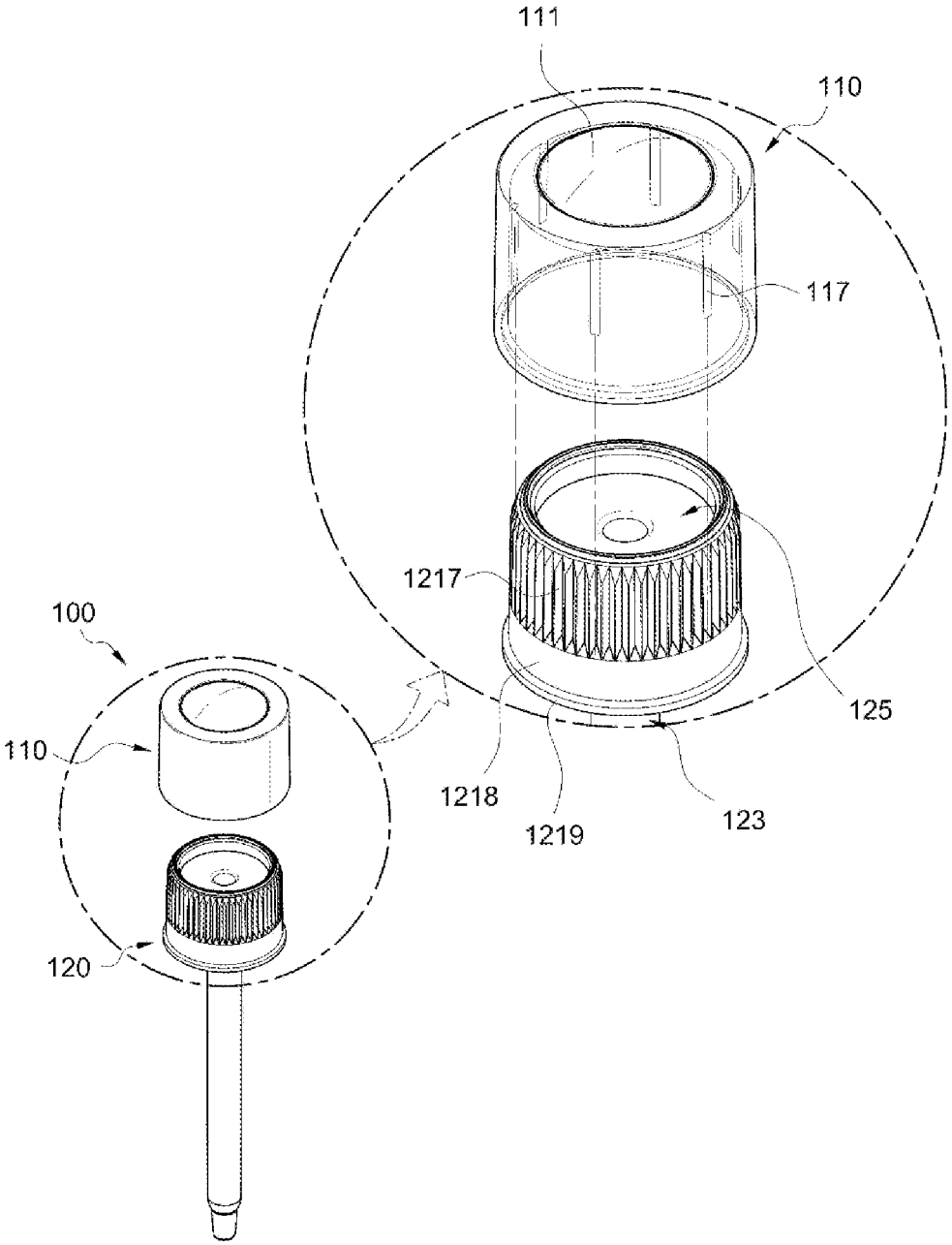
FIG. 2 is an exploded perspective view of the pipette cap according to an embodiment of the present disclosure.
Figure 3:
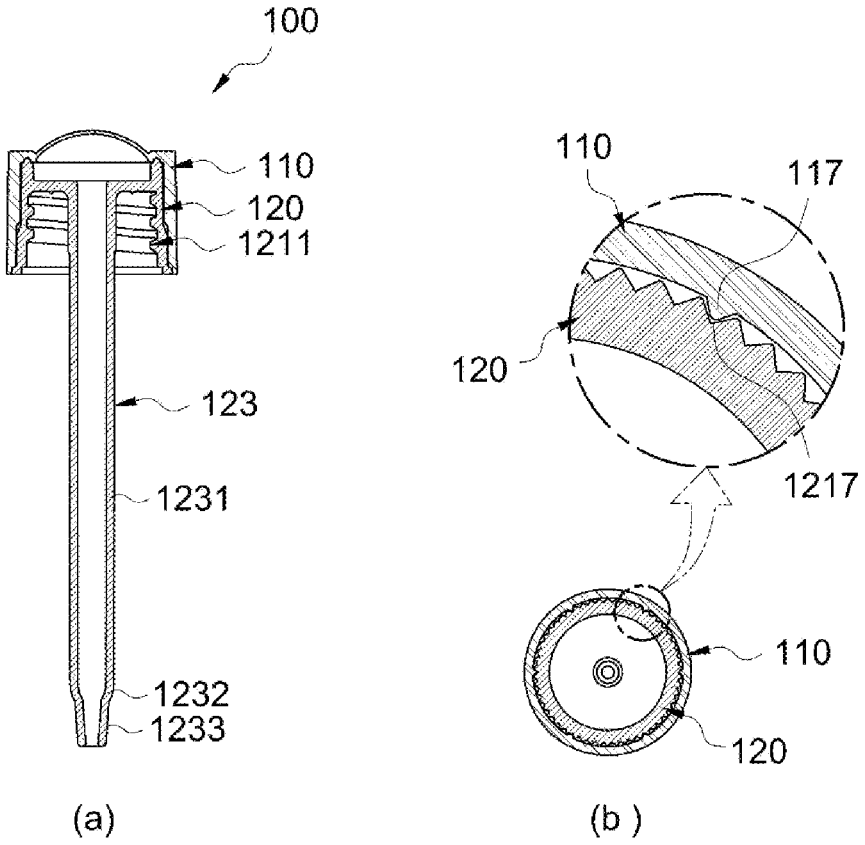
FIG. 3 is a cross-sectional view of the pipette cap according to an embodiment of the present disclosure.
Figure 4:
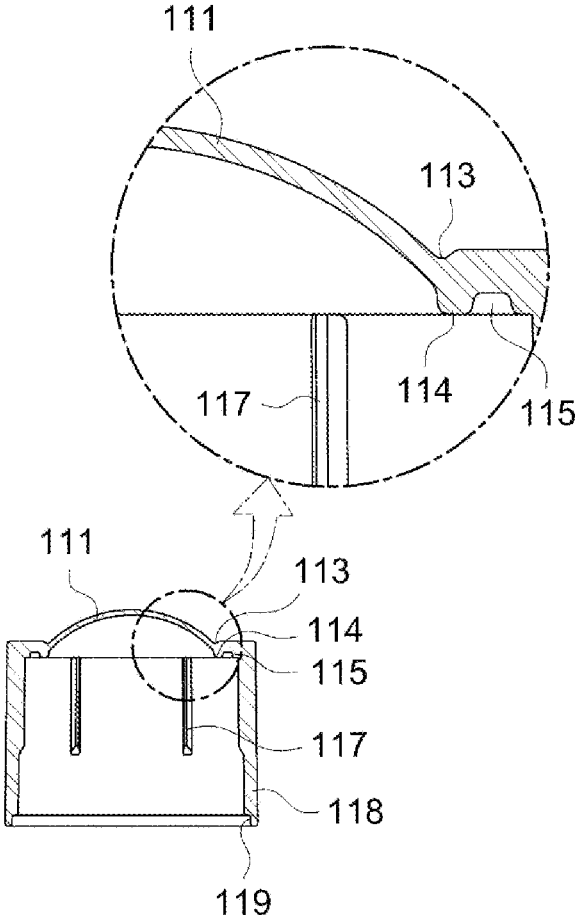
FIG. 4 is a cross-sectional view and an enlarged view of an outer cap according to an embodiment of the present disclosure.
Figure 5:
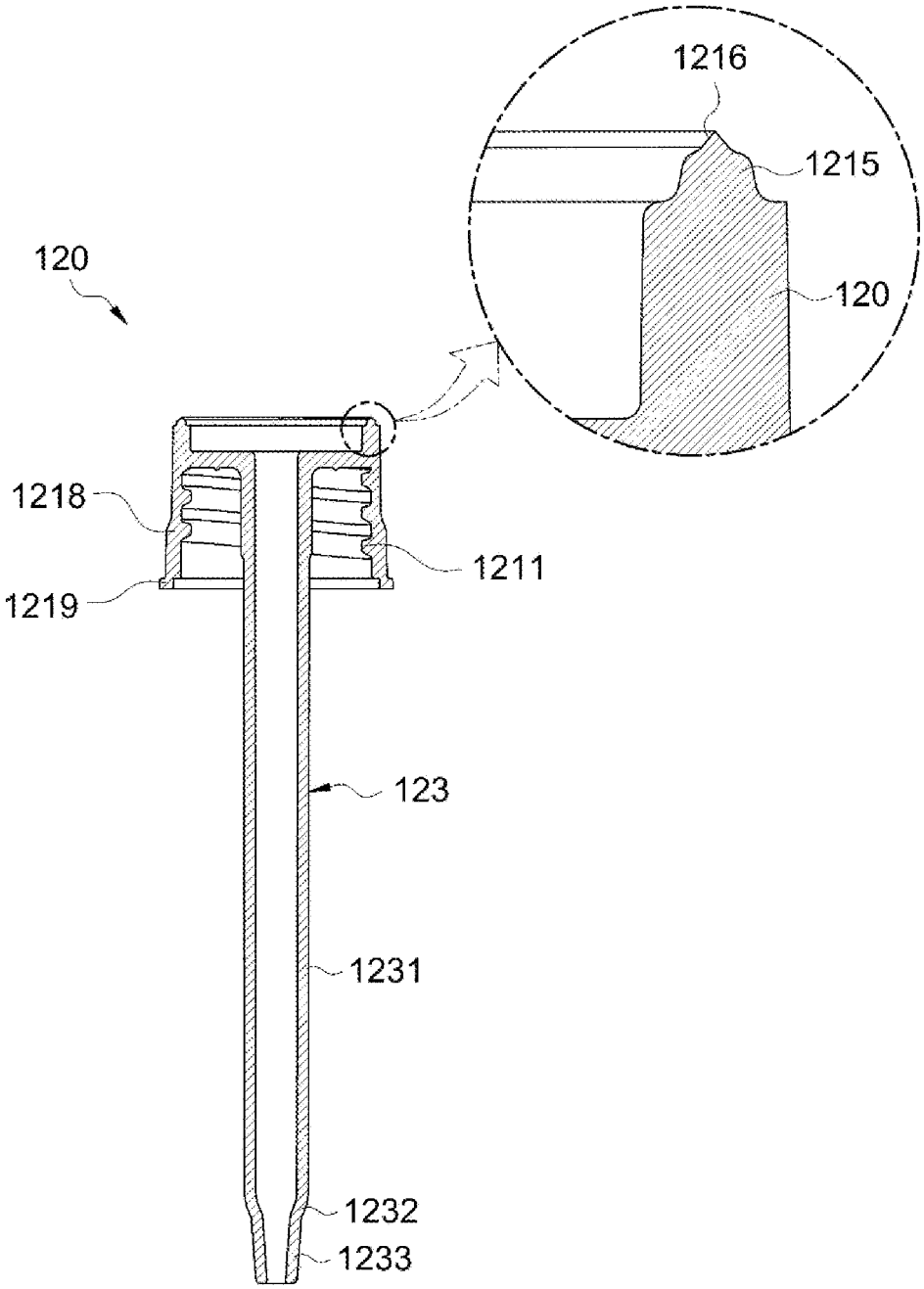
FIG. 5 is a cross-sectional view and an enlarged view of an inner cap according to an embodiment of the present disclosure.

FIG. 1 is a perspective view of a pipette cap according to an embodiment of the present disclosure, FIG. 2 is an exploded perspective view of the pipette cap according to an embodiment of the present disclosure, FIG. 3 is a cross-sectional view of the pipette cap according to an embodiment of the present disclosure, FIG. 4 is a cross-sectional view and an enlarged view of an outer cap according to an embodiment of the present disclosure, and FIG. 5 is a cross-sectional view and an enlarged view of an inner cap according to an embodiment of the present disclosure.

The components of the pipette cap 100 according to an embodiment of the present disclosure will be described in brief. At least a portion of the pipette cap 100 can be integrally formed with a pipette for dispensing contents. More specifically, the pipette cap 100 may include: an outer cap 110 having a pressurizing part 111 formed to undergo deformation and restoration to induce pressure changes inside the pipette 123; and an inner cap 120 coupled to the outer cap 110 and integrally formed with the pipette 123.

In an embodiment, the pressurizing part 111 can be formed to undergo deformation and restoration to induce pressure changes inside the pipette 123. When a user presses the pressurizing part 111 to apply pressure, deformation occurs, an inner space where the pressurizing part 111 and the pipette 123 are connected is reduced. In this instance, the internal pressure of the pipette 123 increases, so the contents inside the pipette 123 is dispensed. When the user releases the pressurizing part 111 while still pressing the pressurizing part 111, the pressurizing part 111 returns to the original shape, so the inner space connected to the pipette 123 is increased. Consequently, the internal pressure of the pipette 123 decreases, so the pipette 123 inhales external contents.

In an embodiment, the pressurizing part 111 may be formed to be thin and have elasticity to facilitate deformation and restoration. For example, the pressurizing part 111 may be formed with a thickness of 0.5T, and the outer cap 110 located outside the edge of the pressurizing part 111 may be formed within a thickness ranging from 1T to 1.5T. The pressurizing part 111 may be formed in a dome shape to evenly transmit pressure, but is not limited thereto.

In an embodiment, the pressurizing part 111 of the present disclosure may be formed of the same material as the outer cap 110 or the pipette 123. For example, the pressurizing part 111 may be formed of polypropylene (PP) material. Conventionally, the pressurizing part 111 is formed of a material different from other parts, such as rubber, to provide elasticity. However, the dropper container according to an embodiment of the present disclosure includes the pressurizing part 111 which is formed of the same material as other components, such as polypropylene (PP), can be disposed of as a whole, thereby facilitating recycling. However, the material of the pressurizing part 111 is not limited to polypropylene, and can be formed of various materials.

The outer cap 110 may additionally include a deformation guide part 113, a restoration guide part 114, etc., in addition to the pressurizing part 111. However, it is not necessary for all the above-mentioned components to be included in the outer cap 110, and only some of the components may be included in the outer cap 110, or additional different components may also be included in the outer cap 110.

The deformation guide part 113 can guide the deformation of the pressurizing part 111 when the pressurizing part 111 is pressed. More specifically, the deformation guide part 113 may be a border between the deformation guide part 113 and the upper surface of the outer cap 110 which is not deformed when the pressurizing part 111 is pressed and deformed, and serve as a guide for helping the injection molding.

In an embodiment, the deformation guide part 113 may have an inclined surface having a predetermined angle relative to the outer side of the upper surface of the outer cap 110 along the edge of the pressurizing part 111, and has a curved bottom groove. For example, the deformation guide part 113 may be formed at an angle of 140 degrees to a depth of 0.2 mm relative to the outer side of the upper surface of the outer cap 110, and may have the curved bottom groove with a curvature of 0.2 mm. Furthermore, to ensure smooth operation at the boundary point between the deformation guide part 113 and the undeformed upper surface of the outer cap 110, the curved surface may be applied. For example, the deformation guide part 113 and the undeformed curved surface of the outer cap 110 may be connected by a curved surface with a radius of 0.2 mm.

In an embodiment, the deformation guide part 113 may be formed as a groove having the size and the shape corresponding to the size and shape of the pressurizing part 111.

The position, size, and shape of the deformation guide part 113 are not limited to the description provided above, and the deformation guide part 113 can be formed in various positions, sizes, and shapes.

The restoration guide part 114 can guide the restoration of the pressurizing part 111 when the pressure on the pressurizing part 111 is released. More specifically, the restoration guide part 114 can serve as a guide to restore the pressurizing part 111 to the original shape when the pressure on the pressurizing part 111 is released.

In an embodiment, the restoration guide part 114 may protrude downward inside the upper surface of the outer cap 110 along the edge of the pressurizing part 111, and may be formed at a predetermined distance inward from the center of the deformation guide part 113 and may have a predetermined thickness. For example, the restoration guide part 114 may protrude on the upper inner surface of the outer cap 110 at a distance of 0.1 mm inward from the center of the deformation guide part 113 to have a thickness of 0.8T. In this case, the restoration guide part 114 which has a thickness of 0.8T supports the pressurizing part 111, which has a thickness of 0.5T.

Furthermore, the curved surface may be applied also to the boundary points among the restoration guide part 114, the pressurizing part 111, and the undeformed upper surface of the outer cap 110, to ensure smooth operation. In this instance, the boundary point between the restoration guide part 114 and the pressurizing part 111 and the boundary point between the restoration guide part 114 and the upper surface of the outer cap 110 can be formed with curved surfaces having different curvatures. For instance, the restoration guide part 114 and the pressurizing part 111 can be connected by a curved surface with a curvature of R=0.5 mm, and the restoration guide part 114 and the upper surface of the outer cap 110 can be connected by a curved surface with a curvature of R=0.3 mm.

Moreover, the inner and outer bottom portions of the protruding restoration guide part 114 can also be formed with curved surfaces. For example, the inner and outer bottom portions of the protruding restoration guide part 114 can each have a curved surface with a curvature of R=0.3 mm.

The position, size, and shape of the restoration guide part 114 are not limited to the description provided above, and the restoration guide part 114 can be formed in various positions, sizes, and shapes.

The outer cap 110 may additionally include an upper coupling groove 115, coupling protrusions 117, a first coupling groove 118, a second coupling groove 119, and the likes, besides the pressurizing part 111, the deformation guide part 113, and the restoration guide part 114. However, it is not necessary for all the components described above to be included, and only some of the components may be included in the outer cap 110, and other components may be additionally included in the outer cap 110.

The upper coupling groove 115 may be formed on the upper inner surface of the outer cap 110 along the outer edge of the restoration guide part 114. In an embodiment, the upper coupling groove 115 is formed to be larger than the outer diameter of the restoration guide part 114, has the size corresponding to the size of an upper coupling part 1215 of the inner cap 120, and can be bonded to the upper coupling part 1215 via ultrasonic bonding. In this instance, through the bonding between the upper coupling groove 115 of the outer cap 110 and the upper coupling part 1215 of the inner cap 120, the inner space where the pressurizing part 111 and the pipette 123 are connected can be sealed, thereby allowing for pressure changes during pressurization and/or depressurization of the pressurizing part 111.

The coupling protrusion 117 protrudes on the inner side wall of the outer cap 110, and at least one or more coupling protrusions 117 may be formed on at least a portion of the inner side wall of the outer cap 110. Referring to FIG. 3, the coupling protrusions 117 are triangular protrusions with smooth apexes in cross-section and can correspond to coupling grooves 1217 of the inner cap 120, which will be described later. For instance, the height of the triangular cross-section of the coupling protrusion 117 can be 0.3 mm. The coupling protrusions 117 can be forcedly inserted into the coupling grooves 1217 of the inner cap 120 to securely fix the outer cap 110 and the inner cap 120 together, thereby preventing the outer cap 110 and the inner cap 120 from rotating relative to each other.

In an embodiment, the coupling protrusion 117 may be formed on a portion of the inner side surface of the outer cap 110, not on the entire inner side surface of the outer cap 110. According to an embodiment, not all coupling grooves 1217 need to be coupled to all coupling protrusions 117. Accordingly, productivity can be enhanced during the coupling process between the outer cap 110 and the inner cap 120.

The position, size, and shape of the coupling protrusions 117 are not limited to the description provided above, and the coupling protrusions 117 can be formed in various positions, sizes, and shapes.

The first coupling groove 118 may be formed below the coupling protrusions 117 along the inner wall of the outer cap, and the second coupling grooves 119 may be formed below the first coupling groove 118 along the inner wall of the outer cap and may be formed larger than the first coupling groove 118. The first coupling groove 118 and the second coupling groove 119 are integrally connected, and the bottom of the second coupling groove 119 is formed in an open cylindrical shape and is coupled with the inner cap 120.

As described above, the inner cap 120 is coupled to the outer cap 110, and is formed integrally with the pipette 123 for dispensing the contents.

The pipette 123 is formed integrally with the inner cap 120, and when deformed and restored depending on pressurization and depressurization of the pressurizing part 111, discharges or inhales the contents due to pressure changes inside. In an embodiment, the pipette 123 may include: a pipette body part 1231 having a constant diameter from the top to the bottom; a first inclined part 1232 extending from the bottom of the pipette body part 1231 and having a gradually decreasing diameter compared to the inner diameter of the pipette body part 1231; and a second inclined part 1233 extending from the bottom of the first inclined part 1232 and having a gradually decreasing diameter compared to the bottom inner diameter of the first inclined part 1232. According to an embodiment of the present disclosure, the content container can inhale or discharge contents with more ease.

The inner cap 120 may include coupling parts for coupling with the container body. More specifically, the inner cap 120 may include a screw thread 1211, the upper coupling part 1215, the coupling grooves 1217, a first coupling part 1218, a second coupling part 1219, etc.

The screw thread 1211 serve as coupling means for coupling with the container body 200 and may be formed on the inner side of the inner cap 120. In an embodiment, the screw thread 1211 of the inner cap 120 may couple with the screw thread 211 of the container body 200.

The upper coupling part 1215 may extend upward along the outer periphery of the upper surface of the inner cap 120. The upper coupling part 1215 may be forcedly coupled to the upper coupling groove 115 of the outer cap 110. In an embodiment, a portion 1216 of the upper portion of the upper coupling part 1215 may be bonded to the upper inner surface of the outer cap 110 via ultrasonic bonding. The portion 1216 of the upper portion of the upper coupling part may be formed in a triangular protrusion shape in cross-section, and the boundary surface can be melted by heating through ultrasonic vibration and can be bonded to the top of the upper coupling groove 115 of the outer cap 110. Through the bonding of the upper coupling part 1215 of the inner cap 120 with the upper coupling groove 115 of the outer cap 110, the inner space where the pressurizing part 111 and the pipette 123 are connected can be sealed, thereby allowing for pressure changes during the pressurization and/or depressurization of the pressurizing part 111.

The coupling grooves 1217 are located on the outer side wall of the inner cap 120, and a plurality of coupling grooves 1217 coupling with the coupling protrusions 117 of the outer cap 110 can be formed. Referring to FIG. 3, the coupling grooves 1217 are formed in a triangular shape that correspond to the coupling protrusions 117 of the outer cap 110. The coupling grooves 1217 can be forcedly coupled with the coupling protrusions 117 of the outer cap 110 to fix the outer cap 110 and the inner cap 120 to prevent relative rotation.

The position, size, shape, etc., of the coupling grooves 1217 are not limited to the description provided, and the coupling grooves 1217 can be formed in various positions, sizes, shapes, etc.

The first coupling part 1218 is located below the coupling grooves 1217 and protrudes to couple with the first coupling groove 118 of the outer cap 110, and the second coupling part 1219 is located below the first coupling part 1218 and protrudes to couple with the second coupling groove 119 of the outer cap 110. The first coupling part 1218 and the second coupling part 1219 are integrally connected, and the bottom of the second coupling part 1219 is formed in an open cylindrical shape and is coupled to the container body 200.

In an embodiment, the outer cap 110 and the inner cap 120 may be made of materials of the same series. More specifically, the outer cap 110 and the inner cap 120 may be formed of a polypropylene (PP) material. However, the present disclosure is not limited thereto, and various materials may be applied according to embodiments to which the present disclosure is applied.

According to an embodiment, the present disclosure can provide an environmentally friendly dropper container since the pipette cap 100 which is made of the same material can be disposed of and separated easily. In addition, since a pumping structure using the injection restoration force of the pressurizing part is formed in an integral unit, the present disclosure can reduce the number of parts, reduce plastic usage, and simplify the manufacturing process, thereby reducing manufacturing costs.

Figure 6:
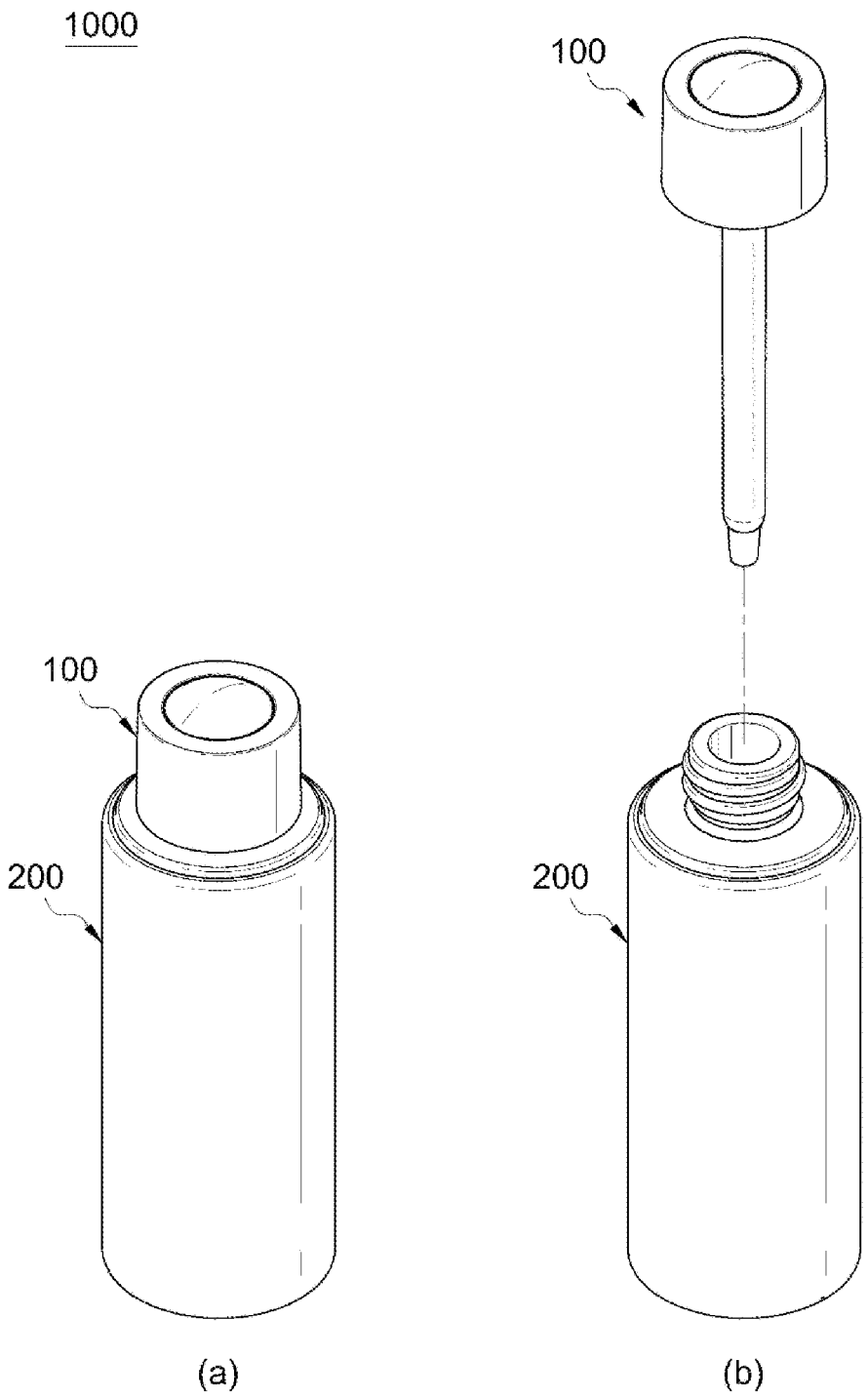
FIG. 6 is a perspective view illustrating the coupling of the pipette cap and a container body according to an embodiment of the present disclosure.
Figure 7:
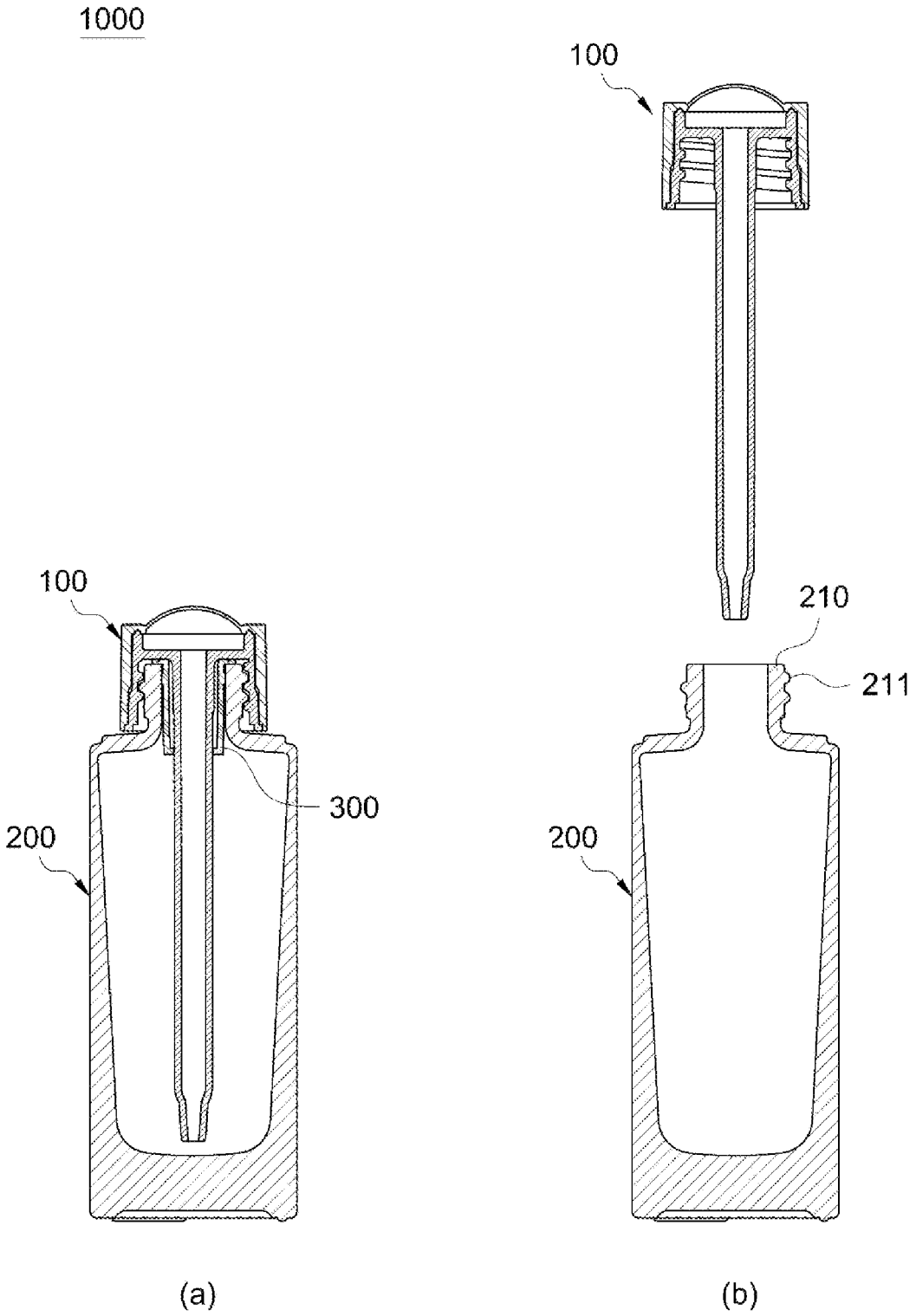
FIG. 7 is a cross-sectional view illustrating the coupling of the pipette cap and the container body according to an embodiment of the present disclosure.

FIGS. 6 and 7 are respectively a perspective view and a sectional view illustrating the coupling of the pipette cap and the container body according to an embodiment of the present disclosure.

Referring to FIGS. 6 and 7, the coupling protrusions 117 of the outer cap 110 are forcedly coupled to the coupling grooves 1217 of the inner cap 120, and the first coupling part 1218 and the second coupling part 1219 correspondingly engage with the first coupling groove 118 and the second coupling groove 119, respectively. The upper coupling part 1215 of the inner cap 120 forcedly engages with the upper coupling groove 115 of the outer cap 110, and the portion 1216 of the upper portion of the upper coupling part 1215 is bonded to the upper inner surface of the outer cap 110 through ultrasonic bonding, thereby coupling the outer cap 110 and the inner cap 120 to form the pipette cap 100.

In this case, the coupling protrusions 117 are formed to allow assembly in any direction when the coupling grooves 1217 are assembled, thereby enhancing the productivity of the pipette cap 100.

Thereafter, the pipette 123 of the pipette cap 100 is inserted into the container body 200, and a spiral thread 1211 of the pipette cap 100 engage with a spiral thread 211 formed externally on a neck part 210 of the container body 200, thereby coupling the pipette cap 100 and the container body 200.

In an embodiment, the dropper container 1000 may further include a wiper 300. In this case, the wiper 300 is positioned inside a neck part 210 of the container body 200, the pipette 123 of the pipette cap 100 is positioned inside the wiper 300, and the spiral thread 1211 of the pipette cap 100 engage with the spiral thread 211 formed externally on the neck part 210 of the container body 200, thereby coupling the pipette cap 100 and the container body 200. In an embodiment, the wiper 300 may be positioned inside the neck part 210 of the container body 200 to remove cosmetic contents stained on the outer wall of the pipette 123.

In an embodiment, the pipette cap 100 including the outer cap 110 and the inner cap 120 may be formed of materials of the same series as the container body 200 and the wiper 300. More specifically, the pipette cap 100, the container body 200, and the wiper 300 may be formed of a polypropylene (PP) material. However, the present disclosure is not limited thereto, and various materials may be applied according to embodiments to which the present disclosure is applied.

According to an embodiment, the present disclosure can provide an environmentally friendly dropper container, allowing disposal of the container without the need to separate parts for disposal.

Figure 8:
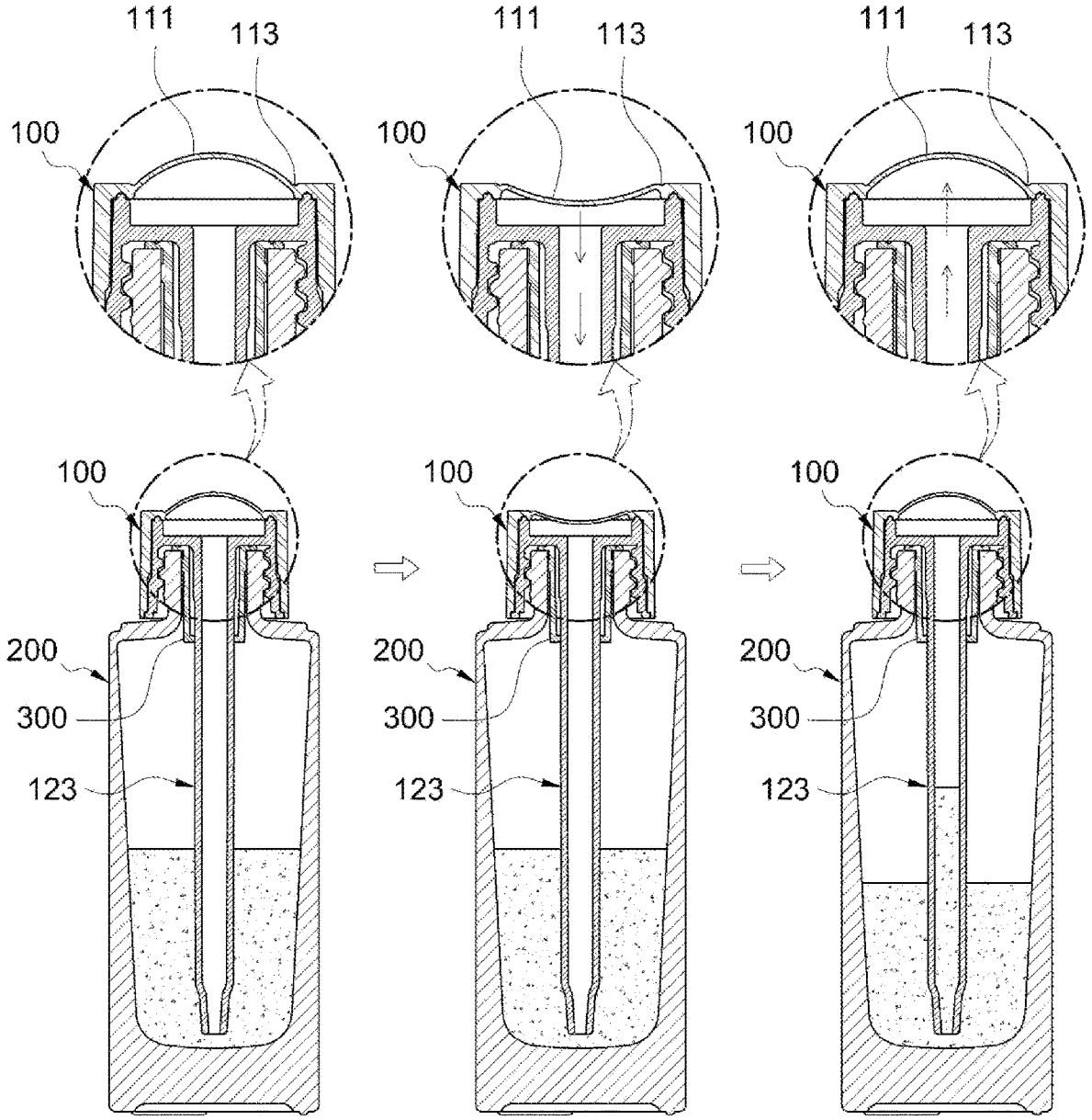
FIG. 8 is a flowchart showing the operation of the dropper container according to an embodiment of the present disclosure.

FIG. 8 is a flowchart illustrating the operation of the dropper container according to an embodiment of the present disclosure.

First, when the user presses the pressurizing part 111 of the outer cap 110 after the pipette cap 100 is locked by being coupled to the container body 200, the pressurizing part 111 undergoes injection molding deformation, and the internal pressure of the pipette 123 is increased.

Thereafter, when the pressurizing part 111 is released, the deformed pressurizing part 111 is restored to its original shape, such that internal pressure of the pipette 123 is decreased and the contents accommodated in the container body 200 is sucked into the pipette 123.

Then, the user rotates the pipette cap 100 to release the coupling between the spiral thread 1211 of the pipette cap 100 and the spiral thread 211 of the container body 200, the pipette cap 100 is separated from the container body 200.

Thereafter, when the user presses the pressurizing part 111 of the outer cap 110 again, the contents accommodated in the pipette 123 can be discharged to the outside.

As described above, the optimal embodiments have been disclosed in the drawings and the specification. Specific terms have been used herein for descriptive purposes, not for purposes of limitation of meanings or to limit the scope of the invention as set forth in the claims. Therefore, it would be understood by those skilled in the art that various modifications and equivalent embodiments are possible from the present disclosure. Accordingly, the true scope of protection of the present disclosure should be determined by the technical concept of the attached claims.

What is claimed is:

1. A dropper container comprising:

a container body for accommodating contents; and a pipette cap for coupling to the container body, wherein at least a portion of the pipette cap is formed integrally with a pipette for dispensing the contents, the pipette cap comprising:

an outer cap including:

a pressurizing part configured to undergo deformation and restoration to cause changes in internal pressure of the pipette, and a deformation guide part located adjacent to the pressurizing part, and configured to guide the deformation of the pressurizing part when the pressurizing part is pressurized, and an inner cap coupled to the outer cap and integrally formed with the pipette, wherein the deformation guide part includes a curved groove, and an inclined surface disposed at a predetermined angle with respect to an upper outer surface of the outer cap, wherein the outer cap further comprises a restoration guide part configured to guide the restoration of the pressurizing part when pressure applied to the pressurizing part is released, and wherein the restoration guide part protrudes downward from an upper inner surface of the outer cap along an edge of the pressurizing part, and has a predetermined thickness at a predetermined distance inward from a center of the deformation guide part.

2. The dropper container according to claim 1, wherein the outer cap and the inner cap are made of materials of the same series.

3. The dropper container according to claim 2, wherein the outer cap and the inner cap are made of polypropylene (PP) material.

4. The dropper container according to claim 1, wherein the inner cap comprises an upper coupling part extending upward along an outer periphery of an upper surface to couple with the outer cap, and wherein an area of the upper coupling part is bonded to an upper inner surface of the outer cap via ultrasonic welding.

5. The dropper container according to claim 1, wherein the inner cap comprises a coupling part for coupling with the container body.

6. The dropper container according to claim 1, wherein the inner cap includes at least one coupling groove defined on an outer circumferential surface thereof, and the outer cap includes at least one coupling protrusion having a corresponding shape to the at least one coupling groove, wherein the at least one coupling protrusion is disposed on at least a portion of an inner side wall of the outer cap, and wherein the at least one coupling protrusion is inserted into the at least one coupling groove to securely couple the outer cap to the inner cap.

7. The dropper container according to claim 1, further comprising a wiper disposed inside a neck of the container body, and configured to remove cosmetic contents strained on an outer wall of the pipette.

* * * * *